United States Patent [19]

Paterson et al.

[11] 4,143,869

[45] Mar. 13, 1979

[54] ADJUSTMENT CLAMP

[76] Inventors: Roy A. Paterson; Alan F. Paterson, both of Princes Hwy., Littlehampton, South Australia, Australia

[21] Appl. No.: 894,759

[22] Filed: Apr. 10, 1978

[30] Foreign Application Priority Data

Oct. 24, 1977 [AU] Australia ..... PD2160

[51] Int. Cl.[2] ..... B25B 5/10

[52] U.S. Cl. ..... 269/166; 269/249

[58] Field of Search ..... 269/166, 171, 147, 203, 269/249

[56] References Cited

U.S. PATENT DOCUMENTS

| | | | |
|---|---|---|---|
| 1,659,342 | 2/1928 | Wetzler | 269/166 |
| 2,512,528 | 6/1950 | Holman | 269/249 |
| 2,528,666 | 11/1950 | Potts | 269/249 |
| 3,403,901 | 10/1968 | Servadio | 269/249 |

*Primary Examiner*—Robert C. Watson

*Attorney, Agent, or Firm*—Jay L. Chaskin

[57] ABSTRACT

A clamp of the type wherein an arm slides along a post, the sliding arm having a clamping jaw guided for vertical movement on its free end and a clamping screw threadably engaging with the free end and operable to effect vertical clamping movement with the clamping jaw.

5 Claims, 3 Drawing Figures

ADJUSTMENT CLAMP

This invention relates to a clamp which can be adjusted so as to clamp over a wide range of throat areas.

BACKGROUND OF THE INVENTION

It is already well known to use a "carpenter's cramp" wherein there is provided a post or bar, a lower anvil or jaw outstanding from the post, and a sliding arm, the sliding arm terminating in a threaded nut at its outer end which is threadably engaged by a screw-threaded member having a ball at one end and a handle at the other, the ball supporting a moving jaw for universal movement. Universal movement is considered necessary because of the change of angle of the arm as the cramp is tightened on a workpiece. Upon aging, the clamping jaw tends to rotate with its screw threaded member, and workpiece clamping becomes difficult.

Thus in U.S. Pat. No. 153,133 (Van Wagoner) there was described and illustrated a clamp wherein a moving arm was tilted with respect to a fixed post, the moving arm terminating in a ball-jointed clamping jaw.

U.S. Pat. No. 237,431 (Colt) discloses a sliding arm which locks upon tilting with respect to a fixed post, and a ball-jointed clamp jaw.

U.S. Pat. No. 248,949 (Pope) similarly discloses a sliding arm which locks upon tilting, and a screw threaded clamp jaw with a rotatable clamping member on one end of the thread, which is otherwise exposed to damage.

U.S. Pat. Nos. 437,403 (Nacke & Brinkmann), and 674,278 (McNutt) also each disclose a ball-jointed clamp jaw.

This invention relates to an adjustment clamp which also has an arm which slides over a post, and has as its main object the provision of a clamping jaw which is guided to remain parallel to the fixed jaw, and to avoid rotation by means other than engagement with the workpiece. A secondary object of the invention is to provide an adjustment clamp wherein the threaded member is reasonably well protected from damage due to weld spatter, paint or other material.

BRIEF SUMMARY OF THE INVENTION

Briefly in this invention, there is provided a clamp having a post, a jaw fixed with respect to the post, a sliding arm which slides along the post but locks upon tilting, a clamping jaw guided for vertical movement by the free end of the sliding arm, and a clamping screw threadably engaging the free end of the sliding arm and operable to effect vertical movement of the clamping jaw.

More specifically, this invention consists of an adjustment clamp having a foot, a post extending from and fixed with respect to the foot, a lower jaw on the foot, an arm having a sleeve at one end and a threaded aperture at the other, the sleeve being movable along the post with the inner walls of the sleeve slidably engaging at the walls of the post but locking on the post upon relative tilting of the sleeve and post, a clamping jaw carried on the free end of the arm, the clamping jaw having walls which engage the free end of the arm and are guided thereby for relative movement in the direction of the fixed jaw, and a clamping screw threadably engaging said threaded aperture in the arm and bearing against said clamping jaw for effecting said relatively movement.

When the shank of a clamping screw passes through an aperture in an upper wall of an open box the lower wall of which is the upper jaw of the clamp, tilting of the box with respect to the arm is substantially avoided, and if the clearance between the sleeve on the arm and the post is relatively small, the extent of tilt therebetween is so small that a relatively even pressure is applied over the whole of the contact surface of the upper jaw against a workpiece.

BRIEF DESCRIPTION OF THE DRAWINGS

An embodiment of the invention is described hereunder in some detail with reference to and is illustrated in the accompanying drawings, in which.

DETAILED DESCRIPTION OF THE PREFERRED EMBODIMENT

Figure 1:
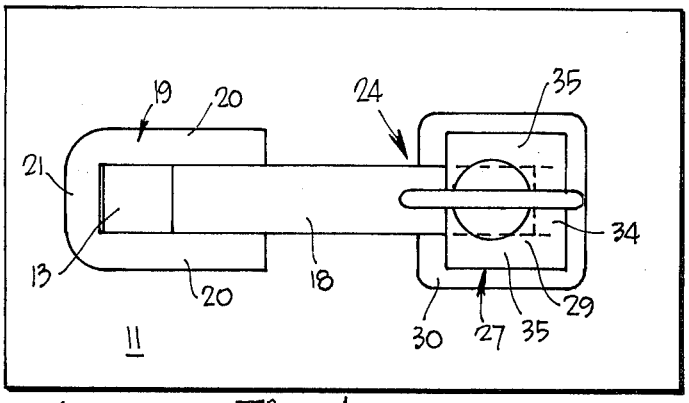
FIG. 1 is a top view of a clamp.

In this embodiment a clamp 10 is provided with a base plate 11 having a foot 12 welded to it, the foot 12 being a horizontal portion of an L-shaped member, the other portion thereof being a post 13 which extends upwardly from the foot 12. The foot has on its upper surface a lower jaw 14, the lower jaw being a plate-like member having a pair of intersecting V-section grooves 15 to facilitate holding round workpieces.

Figure 2:
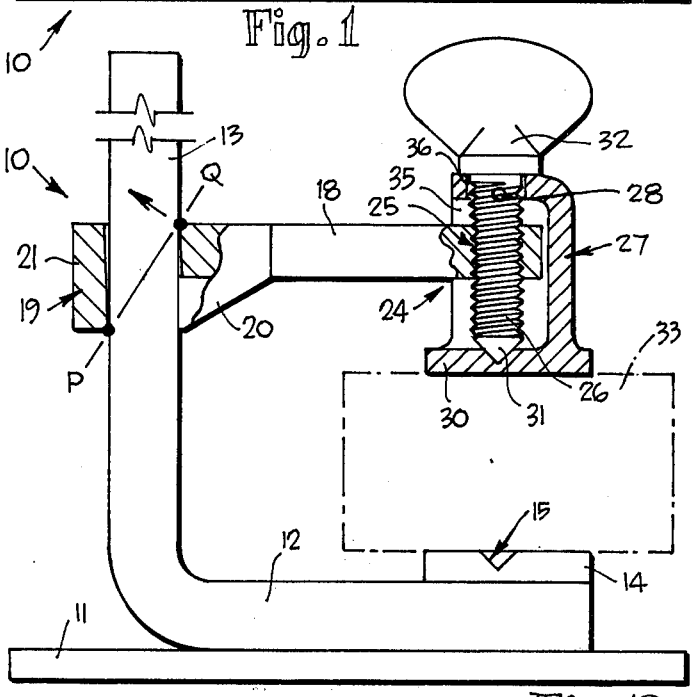
FIG. 2 is a side view of same.
Figure 3:
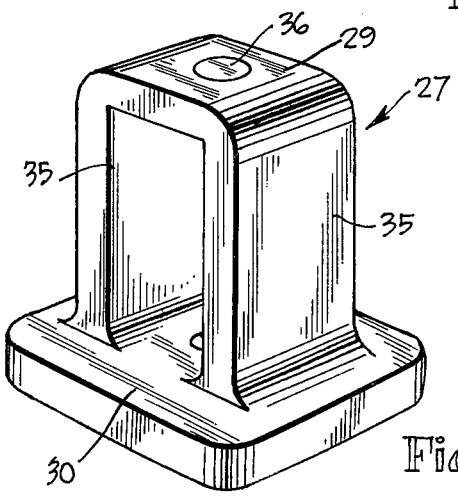
FIG. 3 is a perspective view of the clamping jaw.

The clamp is provided with an arm 18 having a sleeve 19 at one end, and in this embodiment the sleeve has a pair of side wings 20 and a bridge portion 21, the side wings 20 being contiguous with the side surfaces of the post 13 and the bridge portion 21 contiguous with the post back surface, the inner end of the arm 18 being contiguous with the post front surface. The bridge portion 21 is longer than the thickness of the arm 18 and depends below the arm. As can be seen from FIG. 2, the arm 18 will tilt about point P, and the upper rear edge of arm (Designated Q) will move with a large horizontal component of force as indicated by the arrow in FIG. 2, that is it will "dig in" to the front surface of the post with very little tilting of the arm. FIG. 2 is drawn to exaggerate the tilting which actually takes place.

The free end 24 of the arm 18 contains a threaded aperture 25 and this is engaged by a threaded shank of a clamping screw 26. The clamping screw 26 extends through the top wall of an open box designated 27 which functions as the clamping jaw. A crosspin 28 bears against an upper wall 29 of the clamping jaw 27, and retains the lower end of the clamping screw 26 in engagement with the upper surface of the lower wall 30. Alternatively, a compression spring can be used for this purpose. To this end, the lower end terminates in a conical portion 31 and this engages a corresponding conical recess in the lower wall 30. The head 32 of the clamping screw 26 also bears against upper wall 29 when the screw is tightened.

In this embodiment the clamping jaw comprises as its lower wall 30 (which bears against a workpiece 33) a front wall 34, and two side walls 35 in addition to the upper wall 29 having an aperture through which the clamping screw 26 passes. In this embodiment the open box-like clamping jaw 27 is a unitary piece of metal, but it can be comprised by two inter-engaged U-section members one having the upper wall and two side walls and the other having the front wall of the box, and two rearwardly extending lugs which are retained in position by the screw. The latter construction utilises more material but saves the cost of welding or casting.

When the device is to be used, the workpiece 33 is placed on the lower jaw 14 and the arm 18 is moved towards the lower jaw until the workpiece is also contacted by the clamping jaw. The clamping screw 26 is then tightened to firmly clamp the upper jaw to the workpiece, and reaction is achieved by an edge of the rear end of the arm engaging the front surface of the post at point Q with a high unit pressure.

A consideration of the above embodiment will indicate that the invention is essentially very simple. However the device is particularly useful for holding together odd shaped work pieces for the purpose of welding or glueing them together. It can be quickly and easily used, the threaded shank is protected against damage due to spatter, and the upper jaw does not tilt excessively when the clamp is tightened.

The base plate allows the clamp to stand upright for easy placement of pieces to be joined, and when clamped together, the clamp is usually laid prone on a welding table, to facilitate under hand welding. The base plate is either rectangular or square to prevent rocking or rolling whilst welding.

Where pieces to be joined need welding all around the clamp lying prone is supported on each edge of the base plate in twin. Objects of many different shapes, including spheres, can be clamped together.

A typical use is welding a flat bracket on edge to a round pipe at the table, or in situ.

The structure or function of the disclosed embodiments may be modified by one skilled in the art without departing from the scope of the invention as defined by the claims:

What is claimed is:

1. An adjustment clamp having a foot, a post extending from and fixed with respect to the foot, a lower jaw on the foot, an arm having a sleeve at one end and a threaded aperture at the other, the sleeve being movable along the post with the inner walls of the sleeve slidably engaging the walls of the post but locking on the post upon relative tilting of the sleeve and post, a clamping jaw carried on the free end of the arm, the clamping jaw being of box-like shape and have a lower wall, a front wall, an upper wall and a pair of spaced parallel side walls, said side walls engaging the free end of the arm and being guided thereby for relative movement in the direction of the fixed jaw, said upper wall containing an aperture and a clamping screw extending through the upper wall aperture and threadably engaging said threaded aperture in the arm, locating means locating the lower end of the clamping screw with respect to the lower wall of the clamping jaw, and the clamping screw bearing against said lower wall for effecting said relative movement.

2. An adjustment clamp according to claim 1 further comprising a flat base plate welded to the under surface of said foot and extending beyond said foot in all directions to provide a support for the clamp.

3. An adjustment clamp according to claim 1 wherein said locating means comprises a recess in said lower wall co-axial with said aperture in the upper wall, said clamping screw locating at its lower end in said recess.

4. An adjustment clamp according to claim 3 wherein said clamping screw comprises a head which bears against said upper wall simultaneously as its lower end bears against said lower wall, and a crosspin through said clamping screw restrains relative movement between said clamping screw and clamping jaw.

5. An adjustment clamp according to claim 1 wherein said lower jaw contains at least one groove of V formation.

* * * * *